US012202092B1

(12) United States Patent
Muthuveerappan et al.

(10) Patent No.: US 12,202,092 B1
(45) Date of Patent: Jan. 21, 2025

(54) SYSTEM AND METHOD FOR POLISHING THE EDGE OF AN ELECTRONIC DEVICE

(71) Applicant: Communications Test Design, Inc., West Chester, PA (US)

(72) Inventors: Krithika Muthuveerappan, Exton, PA (US); Nidhin Davis, Glen Mills, PA (US); Siddharth Maheshwari, King of Prussia, PA (US); Jaclyn Domsohn, Downingtown, PA (US)

(73) Assignee: Communications Test Design, Inc., West Chester, PA (US)

( * ) Notice: Subject to any disclaimer, the term of this patent is extended or adjusted under 35 U.S.C. 154(b) by 0 days.

(21) Appl. No.: 18/668,321

(22) Filed: May 20, 2024

(51) Int. Cl.

| | |
|---|---|
| ***B24B 29/02*** | (2006.01) |
| ***B24B 41/00*** | (2006.01) |
| ***B24B 41/02*** | (2006.01) |
| ***B24B 51/00*** | (2006.01) |

(52) U.S. Cl.
CPC ..... *B24B 29/02* (2013.01); *B24B 41/005* (2013.01); *B24B 41/02* (2013.01); *B24B 51/00* (2013.01)

(58) Field of Classification Search
CPC ..... B24B 29/02; B24B 41/005; B24B 41/02; B24B 27/0015; B24B 27/0038
See application file for complete search history.

(56) References Cited

U.S. PATENT DOCUMENTS

| | | | | |
|---|---|---|---|---|
| 4,753,044 | A * | 6/1988 | Bula | B24B 27/0076 451/21 |
| 4,894,597 | A * | 1/1990 | Ohtomi | B25J 11/0065 318/568.22 |
| 7,512,457 | B2 * | 3/2009 | Wood | B24B 35/005 901/6 |
| 2011/0081828 | A1 * | 4/2011 | Sweet | B24B 9/20 451/5 |
| 2017/0043477 | A1 * | 2/2017 | Kitayama | B25J 11/0075 |
| 2019/0210177 | A1 * | 7/2019 | Graves | B24B 55/02 |
| 2021/0053173 | A1 * | 2/2021 | Tian | B25J 21/00 |

* cited by examiner

*Primary Examiner* — Joel D Crandall
(74) *Attorney, Agent, or Firm* — Bradley M. Brown

(57) ABSTRACT

A system for polishing the edge of a mobile device is shown and described. The system includes a robot arm which is configured to grab a mobile device. The robot arm is configured to position the mobile device against at least one polishing wheel of a polishing device using a desired force. The system further includes the use of at least one polishing compound. In some instances, the at least one polishing compound is automatically applied to the at least one polishing wheel. In many of these instances the polishing compound is applied at a specific force and for a specific amount of time, ensuring only a desired amount of compound is applied. The system is contained within a chamber having at least one door configured to allow access to the interior of the chamber.

9 Claims, 6 Drawing Sheets

SYSTEM AND METHOD FOR POLISHING THE EDGE OF AN ELECTRONIC DEVICE

BACKGROUND OF THE INVENTION

Technology is always advancing and has done so at a rapid pace for the last several decades. Technology has become sophisticated, smaller, and accessible across the globe. This has led to technology becoming integral in everyday life. As with any integral element of life, the demand is high. This high demand has led to a rise in the cost of technological devices.

In addition to high demand, the simple replacement of devices can be expensive. If one merely discards older equipment or equipment with minor defects for a brand-new piece the cost can escalate quickly. If, however, technology is upgraded, or repaired this process can be much more cost effective for both the company and consumer.

Refurbishing phones or other mobile devices often includes polishing various surfaces of phones. This polishing process removes scratches or other contaminates from the device creating a like new look and feel to the device. However, this polishing process is not as simple as it may appear. If the wrong method of polishing is applied to a mobile device the device may become ruined. This could be due to applying additional scratches or taking to much material from the device. Another aspect could be the removal of paint from the device. This could mean adding additional steps to the refurb process removing any profit from the device.

Many companies have been taking advantage of the repair instead of discard philosophy. Further, many consumers are happy purchasing a lightly used and repaired device instead of a brand new one. However, these processes come with new challenges in order to remain effective. Consequently, there is always a need for an improvement in the art.

SUMMARY OF THE INVENTION

The present invention provides a system and method for polishing the edge of a mobile device wherein the same can be utilized for providing convenience for the user when polishing a mobile device. The system for polishing the edges of an electronic device includes a chamber comprised of plurality of side walls. A frame is used to secure the plurality of sidewalls and various system components. A robot arm configured to secure to and move an electronic device is secured to the frame. A polishing machine is secured to the frame within range of the robot arm. A polishing compound plate which is secured to a pneumatic actuator which is configured to raise and lower the polishing compound plate.

Another object of the system for polishing edges of an electronic device is to have the configuration of the polishing compound plate and the pneumatic actuator be configured to apply polishing compound to the polishing machine Another object of the system for polishing edges of an electronic device is to have at least one electronic device slot secured to the frame within the chamber.

Another object of the system for polishing edges of an electronic device is to have at least one door configured to allow access to the interior of the chamber.

Another object of the system for polishing edges of an electronic device is to have a computer operably coupled to a robot controller.

Another object of the system for polishing edges of an electronic device is to have at least one human machine interface (HMI) operably coupled to the computer.

Another object of the system for polishing edges of an electronic device is to have the HMI be configured to display system information.

Another object of the system for polishing edges of an electronic device is to have the robot arm have an electronic gripper secured to the end which is configured to secure to an electronic device.

Another object of the system for polishing edges of an electronic device is to have a stabilizer secured to the gripper. The stabilizer is configured to rest against at least one side of the electronic device.

Another object of the system for polishing edges of an electronic device is to have at least one polishing compound operably positioned on the polishing compound plate.

The method of polishing an electronic device begins by inserting an electronic device into a chamber of a polishing system. Then enabling the polishing system. Polishing only metallic edges of the electronic device. The polishing is completed in a specific predetermined sequence. The polishing step includes applying polishing compound to a desired polishing wheel of a polishing machine. Finally the electronic device is removed from the polishing system.

Another step of the method for polishing edges of an electronic device is to determine the type of the electronic device.

Another step of the method for polishing edges of an electronic device is to place the electronic device in a correct electronic device slot Another step of the method for polishing edges of an electronic device is to polish the electronic device using a plurality of polishing wheel and polishing compound combinations.

Another object of the method for polishing edges of an electronic device is to have the polishing step conducted using a first polish and a second polish.

Another step of the method for polishing edges of an electronic device is to place the polishing system into a safe state.

Another step of the method for polishing edges of an electronic device is to enter the electronic device unique identifier into the polishing system.

Another object of the method for polishing edges of an electronic device is to have the polishing sequence be determined based upon the device type and polishing need.

Other objects, features and advantages of the present invention will become apparent from the following detailed description taken in conjunction with the accompanying drawings.

BRIEF DESCRIPTION OF THE DRAWINGS

The accompanying drawings are incorporated in and are to be considered part of the present specification. These drawings are meant to aid the reader's understanding and comprehension of the present disclosure and are depictions of various example embodiments. The drawings are not to be considered limiting upon the disclosure. It should specifically be noted that the drawings are examples and may not necessarily be drawn to scale.

DETAILED DESCRIPTION OF THE INVENTION

For the purposes of presenting a brief and clear description of the present invention, a preferred embodiment will be discussed as used for the system and method for cleaning an electronic device with dry ice. The figures are intended for representative purposes only and should not be considered to be limiting in any respect.

Figure 1:
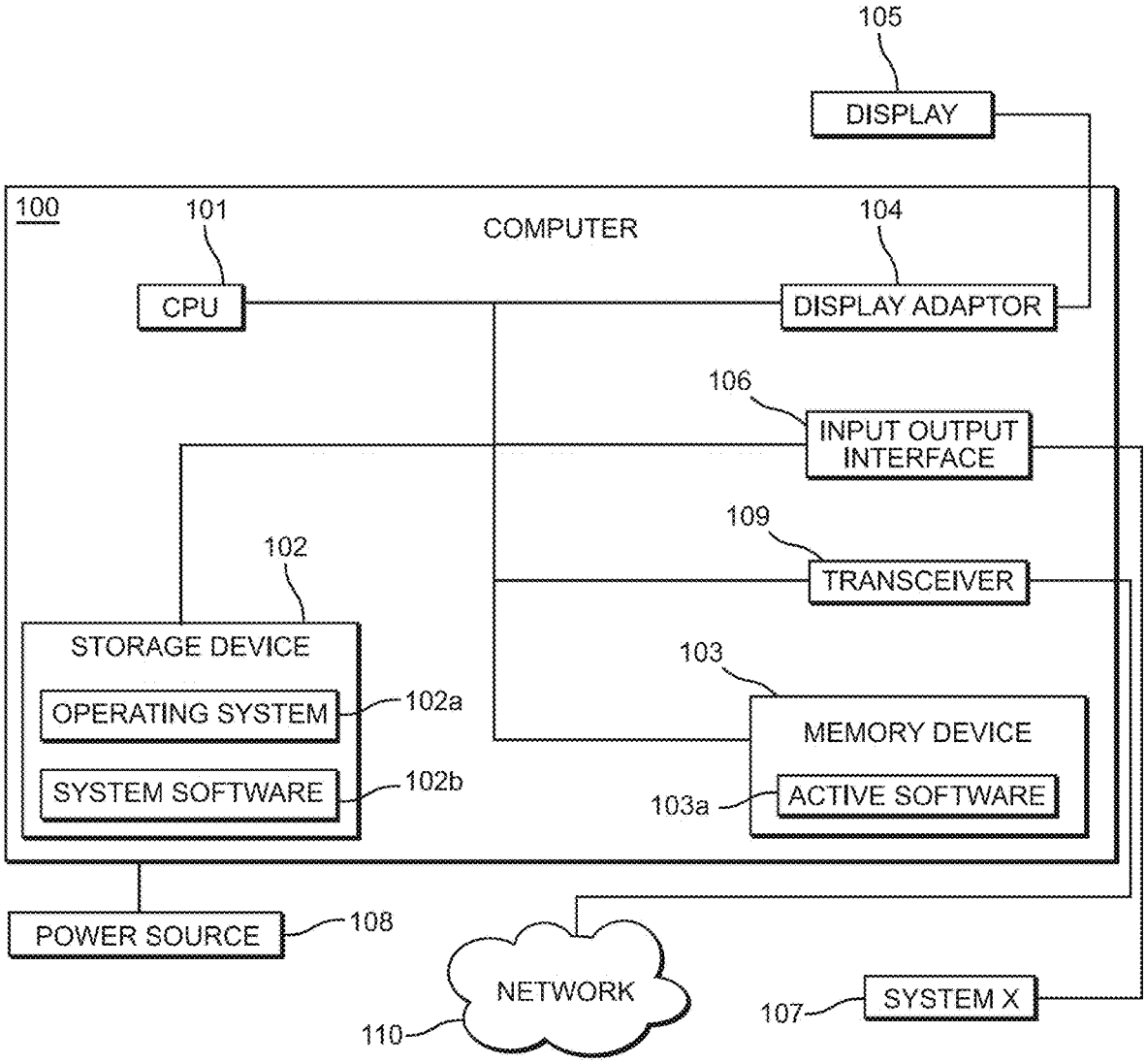
FIG. 1 shows a block diagram of a computing system.

Referring now to FIG. 1, there is shown a block diagram of a computing system. Computing systems may have many interchangeable parts or multiples of some parts. One of ordinary skill in the art will understand that the shown computer 100 is a basic computing system demonstrating a minimal amount of parts to allow for the computer to function. Computer 100 is exemplary, and one of ordinary skill in the art will recognize that computer 100 may be altered as necessary to render the presently disclosed system operable or to provide a peak performance of the disclosed system.

The parts described are each operably coupled together as necessary, one of ordinary skill in the art will understand how to connect general computer components, for example by use of a mother board or other computer board. In the shown embodiment the computer 100 includes a CPU 101. In one embodiment the CPU 101 includes only one processor. In other embodiments the CPU 101 may be made up of multiple processors. Different processors will allow for different computing power and speed.

The computer 100 includes at least one storage device 102. In different embodiments the at least one storage device 102 may be a solid-state storage device, a disk storage device, or another suitable storage device. One of ordinary skill in the art will recognize that there are several types of computing storage devices each providing well-known benefits and drawbacks. The at least one storage device 102 will store at least the computer operating system 102*a* and system software 102*b*. System software 102*b* may include any software necessary, or optionally, used to run any system described herein.

The computer 100 will have at least one memory device 103. One of ordinary skill in the art will recognize that there are several types of computing memory devices each providing well known benefits and drawbacks. The at least one memory device 103 will store at any active software 103*a*. Active software 103*a* may include the operating system 102*a* or parts of the system software 102*b*. The at least one memory device 103 may store the entire system software 102*b* size and speed permitting.

The computer 100 may also include various connection ports and types. The computer 100 may have a display adaptor 104. The display adaptor 104 will allow the computer 100 to connect to at least one display 105. In other embodiments multiple displays may be connected to the display adaptor 104. Similarly, the computer 100 may include at least one input/output interface 106. The input/output interface 106 will allow the computer 100 to connect to at least one system, referred to as System X 107 in FIG. 1. The input/output interface 106 may also allow for connection to only part of System X 107 or multiple systems. The computer 100 will also be operably connected to a required power source 108.

The computer 100 may also include a transceiver 109. In one embodiment the transceiver 109 is a wired transceiver. In another embodiment the transceiver 109 is a wireless transceiver. The transceiver 109 will allow the computer 100 to connect to a network 110. The network 110 may be an internet or an intranet connection. The network 110 will allow for the computer 100 to potentially connect to multiple other computing devices. In another embodiment the network may allow for the computer 100 to connect to multiple systems. In one embodiment the computer 100 will allow for System X 107 to be connected to the network 110.

Figure 2B:
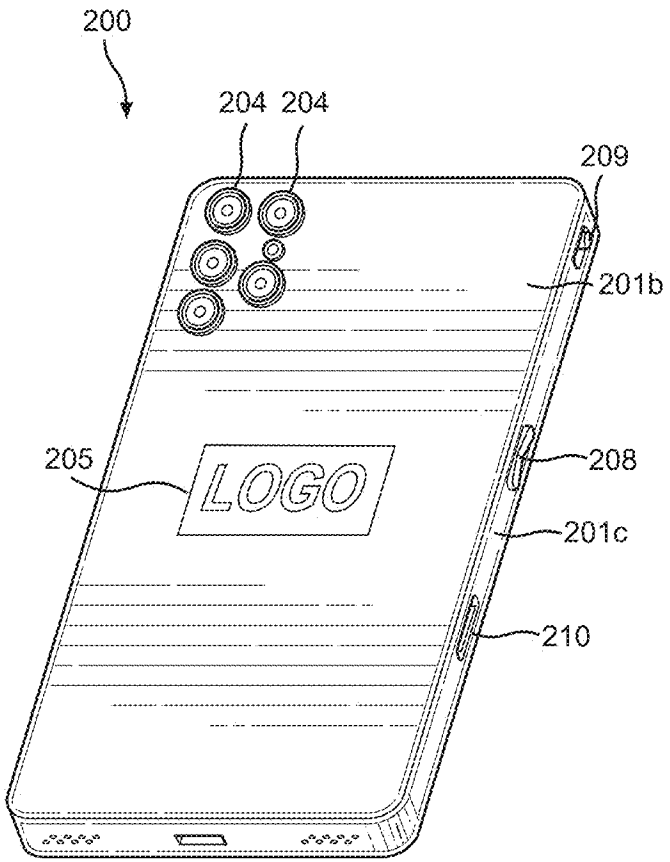
FIG. 2B shows a rear view of an example of an electronic device.
Figure 2A:
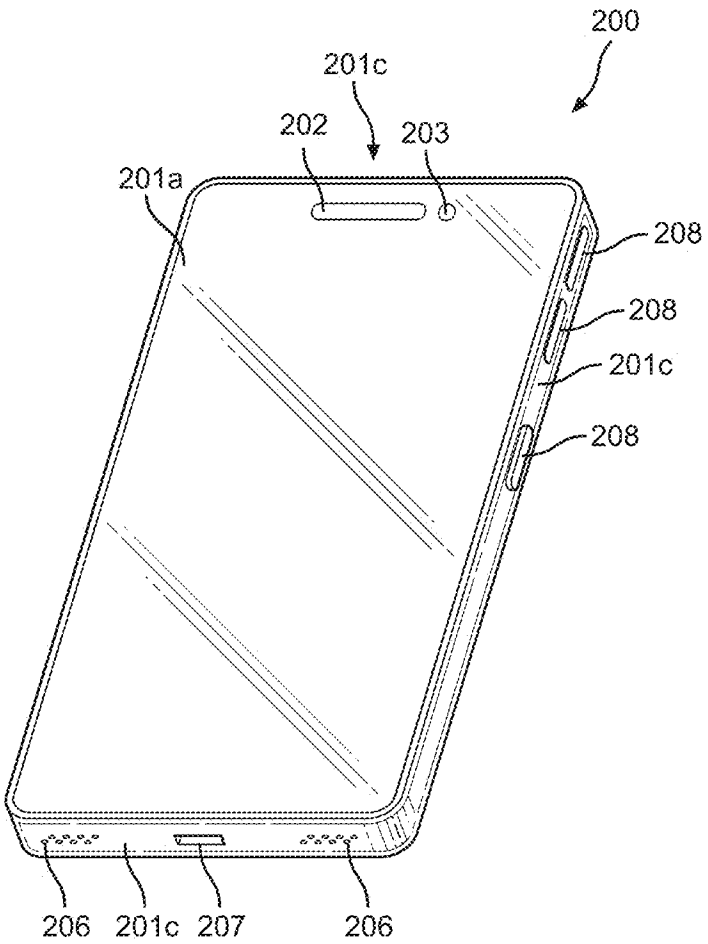
FIG. 2A shows a front view of an example of an electronic device.

Referring now to FIG. 2A and FIG. 2B, there is shown a front view and a rear view of an example of an electronic device 200, such as a mobile phone device. Electronic devices may have many different parts and components. Even like parts or components may be in various locations or have different shapes and sizes. One of ordinary skill in the art will understand that the shown electronic device 200 is merely an example of the exterior of a device. Any specialized or specific features or requirements of devices will be detailed herein as necessary. However, one of ordinary skill in the art will understand that many electronic devices 200 have many of these described characteristics. Further, electronic devices, such as mobile phone devices, operate on a computer-based platform having many of the computer parts as described in FIG. 1. The below description seeks to detail external components and not the computer which runs the electronic device 200. The electronic device 200 can be, without limitation, a mobile phone device, or a tablet. In one embodiment other electronic devices may be used such as laptops, cable set top boxes, routers, or antennas.

The shown electronic device 200 includes a front surface 201*a*, a rear surface 201*b*, and four side surfaces 201*c*. The front surface 201*a* typically includes a screen which covers a majority of the surface. The screen is typically covered with a specialized material, currently a glass product. The front surface 201*a* may also include a speaker opening 202 and a camera opening 203.

The rear surface 201*b* of the electronic device 200 may include at least one camera lens 204. In the shown embodiment there are a plurality of camera lenses 204. In another embodiment at least one light lens is secured to the rear surface 201*b*. In many embodiments the rear surface 201*b* includes a logo 205. The logo 205 may represent the company which created the electronic device 200. The rear surface 201*b* may include a coating or covering to decorate or protect the rear surface. For example, a coating may be applied to the rear surface 201*b* to ensure a shiny surface.

The side surfaces 201*c* of the electronic device 200 may include any or all of the following parts. In one embodiment the electronic device 200 will have several openings for speaker output 206. The electronic device 200 will also include a charging port 207. Charging ports 207 may include a prong therein to secure to a charging cord. An electronic device 200 may include a plurality of buttons 208 along the side surfaces 201*c*. In different embodiments the plurality of buttons 208 may allow for volume control, locking the electronic device 200, or other desired functions. In some embodiments the electronic device 200 may include a switch 209. In yet another embodiment the electronic device 200 includes a SIM card slot or other card slot 210.

Figure 3:
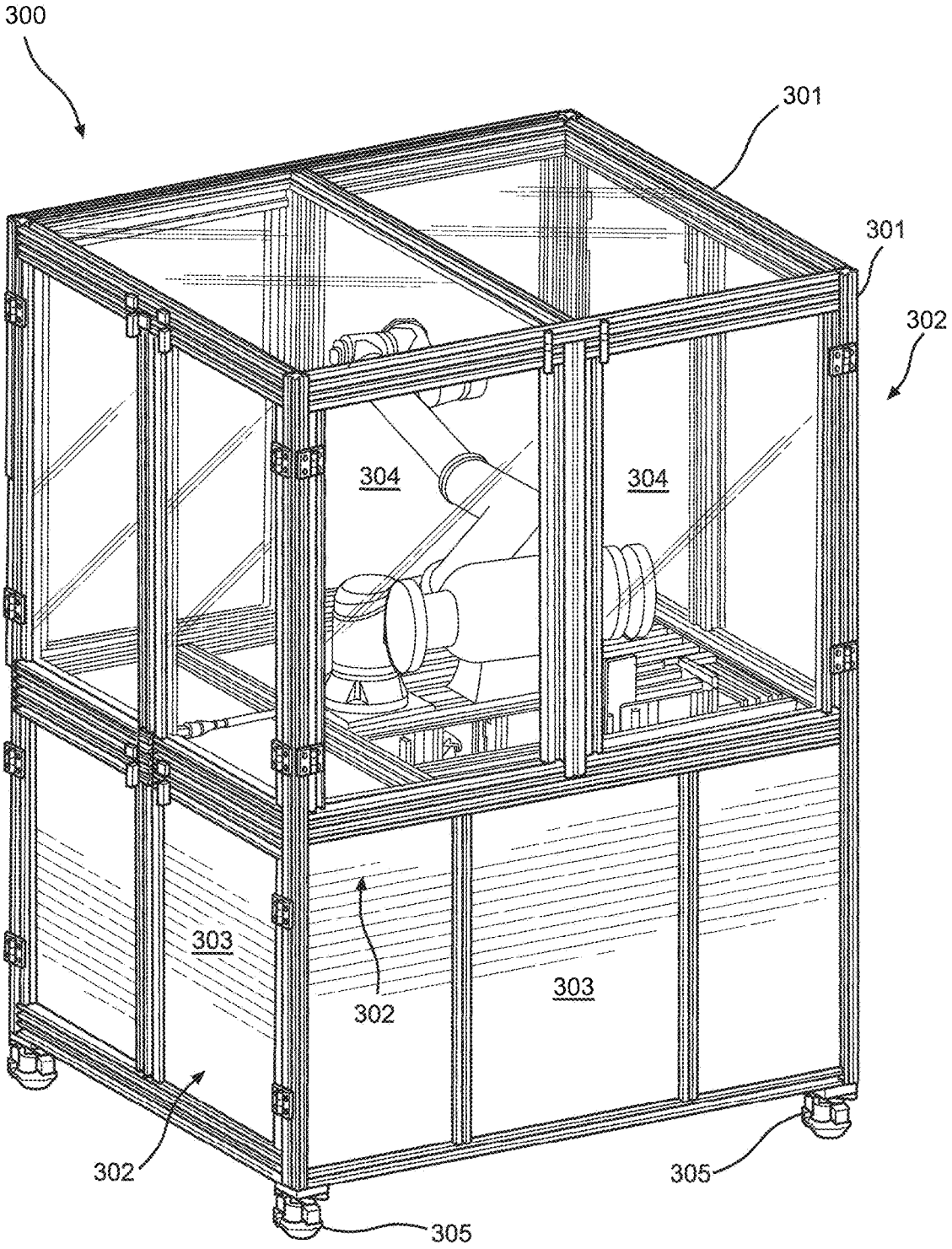
FIG. 3 shows a perspective view of an embodiment of the system for polishing the edge of an electronic device.

Referring now to FIG. 3, there is shown a perspective view of an embodiment of the system for polishing the edge of a mobile device. The system for polishing the edge of a mobile device is built inside a chamber 300. The chamber 300 includes a frame 301. The frame 301 includes supports which are configured to hold various doors 302, side panels 303, and windows 304. In some embodiments the doors 302 are created from windows 304. The doors 302 allow a user to access the interior of the chamber 300. The windows 304 will allow for visual inspection of the interior of the chamber 300, especially when the system is in use as will be described herein.

In one embodiment the chamber 300 includes a plurality of feet 305. In some embodiments each one of the plurality of feet 305 include a wheel. In some embodiments the feet 305 have an adjustable height. This will allow for the chamber 300 to be leveled by adjusting the feet 305. Further, the feet 305 can add to the stability of the chamber 300.

Figure 4:
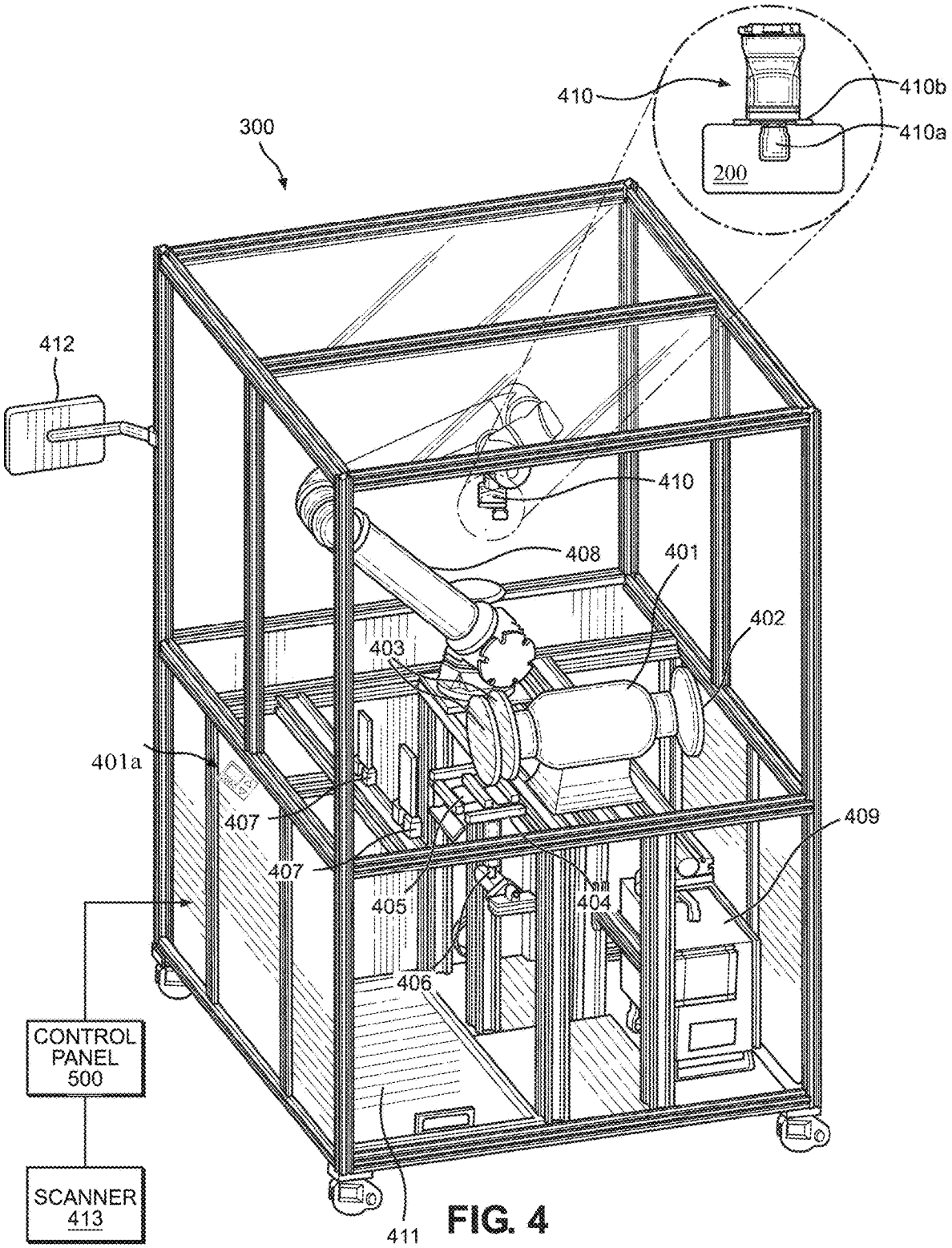
FIG. 4 shows a perspective view of an embodiment of the system for polishing the edge of an electronic device, with sidewalls removed.

Referring now to FIG. 4, there is shown a perspective view of an embodiment of the system for polishing the edge of a mobile device, with sidewalls removed. From this perspective many of the components of the system for polishing the edge of an electronic device are shown. The system for polishing the edge of an electronic device includes a control panel 500. The control panel 500 is discussed in detail in FIG. 5. In the shown embodiment the control panel 500 is placed on a side of the chamber 300 away from a polishing machine 401 facing away from the polishing machine 401. This will protect the components of the control panel 500 from polishing compound 405 and other debris.

In the shown embodiment the polishing machine 401 is located on the right front side of the chamber 300. The polishing machine 401 may be located in different places of the chamber 300 as necessary. In one embodiment the polishing machine 401 is an 8 inch variable speed industrial buffer. One of ordinary skill in the art will understand that various machines which are commercially available can be used to fulfill the purpose and requirements of the polishing machine 401. In one embodiment as discussed below the polishing machine 401 is capable of spinning polishing wheels at 3600 RPM. In one embodiment the controller 401*a* for the polishing machine 401 is positioned on the exterior of the chamber 300.

In the shown embodiment the polishing machine 401 has a wheel 402 secured to one side of the device. In one embodiment the wheel 402 is a counterweight. In another embodiment the wheel 402 is a fine polishing wheel which can be used as desired during the polishing process. This wheel 402 is in no way mandatory for the polishing process.

The polishing machine 401 has at least one polishing wheel 403 secured to the side of the machine opposite wheel 402. In one embodiment a two wheels 403 are secured to the same side of the polishing machine 401. One of ordinary skill in the art will understand that different combinations and configurations of polishing wheels can be used to accomplish an electronic device edge polish. In one embodiment the polishing wheel 403 is a dry polishing wheel. In another embodiment the polishing wheel 403 requires a polishing compound 405.

In the shown embodiment situated below the polishing wheels 403 is a polishing compound plate 404. The polishing compound plate 404 will hold polishing compound. In one embodiment the polishing compound plate 404 is specially configured to hold polishing compound 405 and apply it to the polishing wheel(s) 403. One of ordinary skill in the art will understand that the polishing compound plate 404 can be altered to match the configuration of the polishing wheel(s) 403. In one embodiment multiple polishing compound plates 404 can be used to best apply polishing compound to the polishing wheel(s) 403.

Polishing compounds can be found from many providers in the industry and are generally of a standard composition. One of ordinary skill in the art will understand that many different combinations of polishing wheels and polishing compounds, from varying manufactures can be used to achieve similar results. These combinations can be determined without undue experimentation.

In one embodiment the polishing compound plate 404 is secured to a pneumatic actuator 406. The pneumatic actuator 406 may be used to ensure that polishing compound 405 is always applied to the polishing wheels 403 at a uniform and identical pressure even as the polishing compound 405 is used and worn away. In the shown embodiment, when triggered, the pneumatic actuator 406 will rise the polishing compound plate 404 such that the polishing compound 405 will contact the polishing wheel(s) 403.

The polishing system includes at least one electronic device slot 407. The electronic device slot 407 is located within the chamber 300 and allows for a electronic device 200 to be placed therein. In one embodiment there is more than one electronic device slot 407. In one embodiment this allows for multiple electronic devices to be polished before the system needs to be reloaded. In another embodiment each electronic device slot 407 is configured to fit only a certain electronic device or group of electronic devices therein. Many electronic devices have varying dimensions. By having multiple electronic device slots 407 many different types of electronic devices can be placed in the polishing system with a stationary electronic device slot 407.

The system includes a robot arm 408. In one embodiment the robot arm 408 is a UR10e collaborative robot arm. The robot arm 408 is operably coupled to a robot controller 409. The robot controller 409 is operably coupled to the control panel 500 and its components. The robot arm 408 is configured to pick up an electronic device 200 and place the device against the polishing wheel(s) 403 in order to polish the edges of the mobile device.

In some embodiments in order to facilitate the grabbing and polishing of an electronic device the robot arm 408 is fitted with a grabber head 410. Various types of grabbers can be used as the grabber head 410. However, in one embodiment an electric grabber is used. In one embodiment the electric grabber can apply a constant 100 N of force to the electronic device 200. This will secure the electronic device 200 for polishing without damaging the electronic device 200. In some instances, grabber tips 410*a* are secured to the grabber 410. The grabber tips 410*a* will increase the coefficient of friction creating a better hold of the electronic device 200.

In some embodiments the grabber 410 includes at least one stabilizing part 410*b*. In some instances the electronic device 200 being polished will tilt in the grabber 410. In order to correct this issue in some embodiments a stabilizing part 410*b* is secured to the grabber 410 such that it rests along one side of the electronic device 200. This will apply pressure to the electronic device 200 such that it will help stabilize the electronic device when polishing.

In one embodiment the system includes a removable tray 411. The removeable tray 411 can be positioned below the polishing tool 401. This will allow for excess polishing compound 405 or other particles, which would otherwise be stuck to the chamber 300, to be easily removed. The tray 411 can be removed from the chamber 300, cleaned, and replaced.

In some embodiments a human machine interface (HMI) 412 is included as part of the polishing system. The HMI 412 will allow a user to see various aspects of the polishing system and system information. For example, the HMI 412 may show any or all of the following: the electronic device's model, the polishing process status, a time to completion, a completed signal, system logs, errors, a number of devices polished, an emergency stop, and robot controls. In one embodiment the HMI 412 will display a start button which must be selected in order to begin the polishing process. This button may be selected with an input device such as a mouse, keyboard, or via a touch screen.

In one embodiment the polishing system further includes a scanner 413. The scanner 413 can be used to scan a barcode or other identifying item of an electronic device to be polished. When the electronic device is identified the system may automatically determine a proper sequence for polishing the device (as described below). Further in some embodiments the electronic device 200 can have its status updated in a master tracking system.

Figure 5:
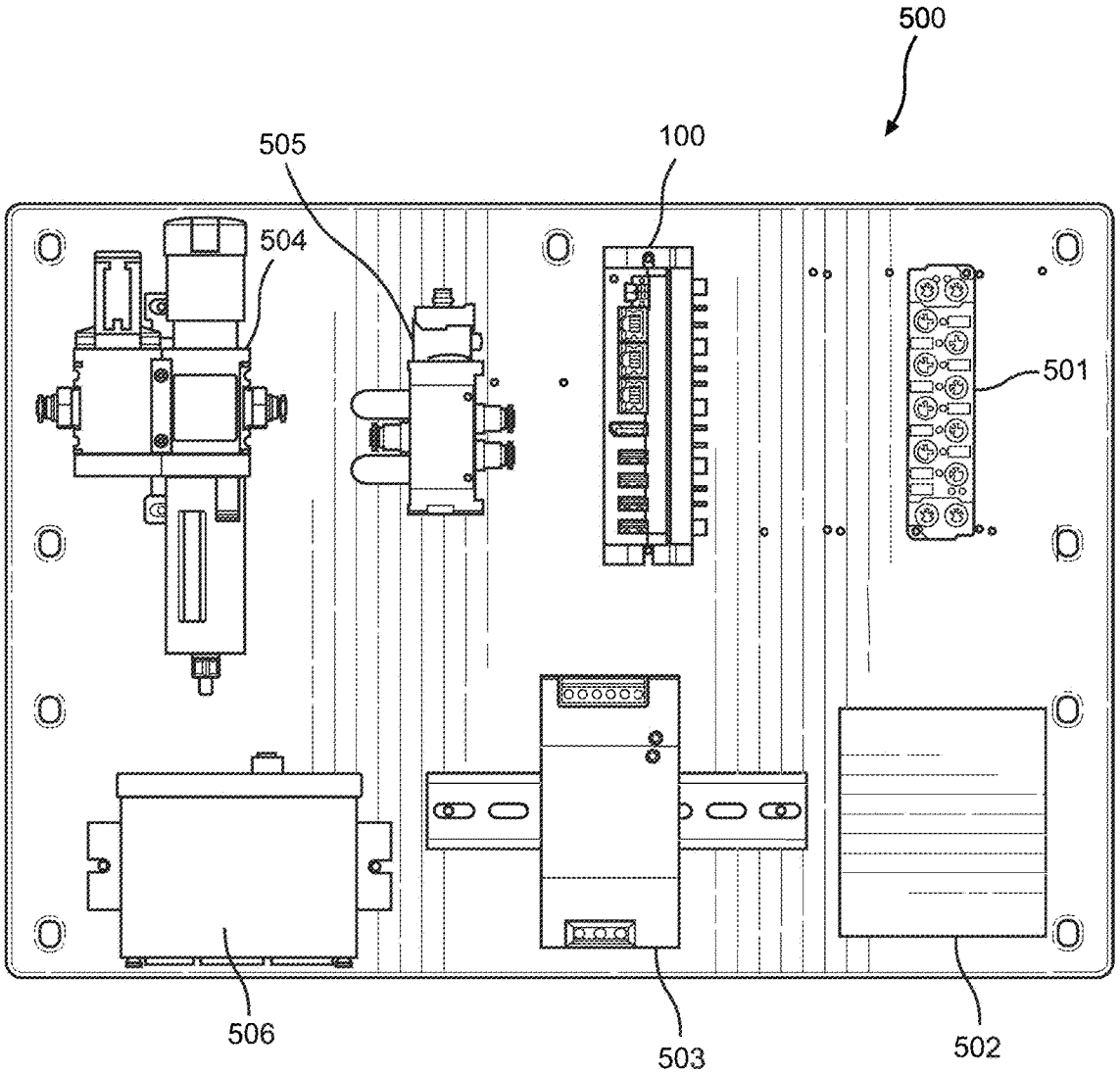
FIG. 5 shows a top down view of an embodiment of a control panel for the system for polishing the edge of an electronic device.

Referring now to FIG. 5, there is shown a top down view of an embodiment of a control panel for the system for polishing the edge of a electronic device. The control panel 500 secures many of the major necessary components for the functionality of the system for polishing the edge of an electronic device. In the shown embodiment the control panel includes a computer 100, which contains at least the processor and several ports. The control panel 500 also includes at least one etherCAT box 501. The at least one etherCAT box 501 will facilitate the necessary connections for the polishing system to properly function. In some embodiments the control panel 500 also includes an ethernet spitter 502. The ethernet splitter 502 will facilitate additional connections. In the shown embodiment the ethernet splitter 502 is used to connect the computer 100 to the robot controller and other control systems as needed.

The control panel 500 includes a power supply unit 503. The power supply unit 503 will help regulate and provide the necessary power to the polishing system. The robot controller and the polishing tool may receive power independent of the power supply unit 503.

The control panel 500 includes several air system components in addition to the computer components and electrical components. In the shown embodiment the control panel 500 includes a combination air filter and regulator 504. This will ensure that air is clean and does not clog the system as well as ensuring that air enters the system at a desired pressure. The air filter and regulator 504 is connected to a manifold assembly 505. The manifold assembly 505 will connect to and run the air components of the system.

A gripper control 506 is also secured to the control panel 500. The gripper control 506 is operably coupled to the system especially the computer 100 and the robot arm controller and will control the gripper which is secured to the robot arm. The gripper control 506 will open and close the gripper at the appropriate times in order to secure a electric device 200 therein.

Figure 6:
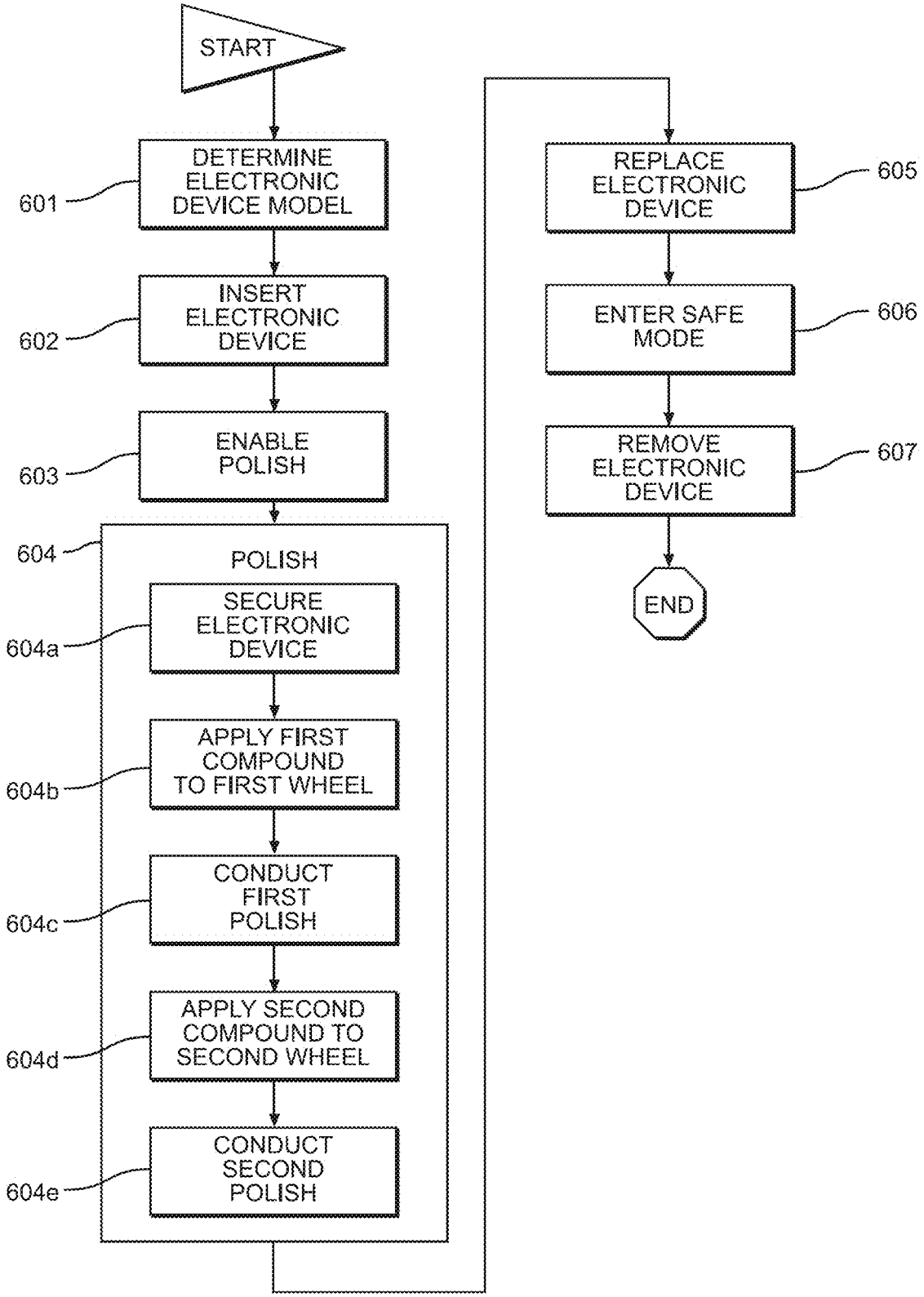
FIG. 6 shows a flow chart for an embodiment of the method for polishing the edge of an electronic device.

Referring now to FIG. 6, there is shown a flow chart for an embodiment of the method for polishing the edge of an electronic device. In one embodiment the system for polishing the edge of an electronic device employes this, or a similar, method to polish an electronic device edge. The method starts by determining the type of electric device to be polished 601. The determination process may be conducted in any number of different ways. For example one may simply look at the back of a electronic device. In another embodiment the determination step may be mixed with inserting the electronic device into the system 602.

In one embodiment inserting the electronic device into the system 602 only includes placing the electronic device into the electronic device slot. In another embodiment the insertion process 602 includes entering the electronic device into the system via a unique identifier. In one embodiment upon entering the unique identifier into the system the type of electronic device may be displayed on the HMI. Before moving to the next step, the electronic device must be physically inserted into the proper electronic device slot within the chamber for polishing.

After the electronic device's type has been determined and the electronic device has been properly inserted into the chamber the system must be enabled 603. In one embodiment the system may recognize that an electronic device is ready for polishing via any number of sensors. In another embodiment the system receives a signal to enable the polishing process 603. In one embodiment the signal could be a door closed sensor. In another embodiment the signal is the insertion of a signal to the system by a user.

The next step is polishing the electronic device 604. In one embodiment the polishing tool is started to begin this step. In another embodiment the polishing tool remains constantly running. In different embodiments the polishing tool may be set to different RPM settings. Many industry standards exist, and many polishing compounds provide guidance to suggested RPM settings depending on Wheel type and compound types. In various embodiments using the components described in the description of FIG. 4 roughly a 3600 RPM setting can be used.

After determining that the polishing tool is active and set to a desired setting the polishing 604 can begin. The polishing 604 starts when the robot arm secures the electronic device 604*a* within the grabber. In one embodiment the grabber used a force of 100 N to secure the electronic device. After the electronic device has been secured 604*a* a first polishing compound is applied to a first polishing wheel 604*b*. In one embodiment the first polishing compound is applied to the first polishing wheel at a rate of 2 seconds every 90 seconds. In this manner a predetermined amount of the first polishing compound is applied to the first polishing wheel. In some embodiments the wheels are configured such that this step may be skipped and no polishing compound is needed for polishing.

In another embodiment a second polish 604*e* is conducted. In this embodiment the first polish 604*c* is a rougher polish using a courser polishing compound and a harder polishing wheel. In this embodiment the second polish 604*e* using a softer polishing wheel and a finer polishing compound. The second polish 604*e* begins with applying a second polishing compound to a second polishing wheel 604*d*. In one embodiment the second polishing compound is applied to the second polishing wheel at a rate of 2 seconds every 90 seconds. In this manner a predetermined amount of the second polishing compound is applied to the second polishing wheel. In this embodiment this is where the polishing method ends. Using this method and system reduces the polishing time per device from almost 25 minutes per device to between 8 and 9 minutes per device.

In some embodiments the polishing 604 is conducted using at least one predetermined sequence. In some embodiments there are a plurality of predetermined sequences saved in the storage of the computer. In some embodiments the polishing 604 begins by determining which predetermined sequence to use to polish the device. In some embodiments the polishing sequence is selected based on device type. In another embodiment the polishing sequence is selected based on polishing needs (for example a greater or lessor polishing). In some embodiments a polishing sequence is determined based on a combination of desired factors.

In different embodiments different pressures are used to perform the polishing. In some embodiments the use of specific force applied in the correct way can prevent the polishing process from ruining the electronic device. In one embodiment the sides of the electronic device containing buttons or switches have 1 N applied. In one embodiment the force is applied in a waive as the system finds the correct location to apply the proper force. In one embodiment the curve is applied such that the force must stay within 40% of the desired force. This is typically used on the volume control buttons to help prevent excessive polishing to the volume buttons. In another embodiment the power button side of the electronic device has force applied in a manner that is within 75% of the desired force. In some embodiments the top and bottom of the electronic device has a force of 2 N applied. In one embodiment the force applied in a manner that is within 75% of the desired force.

Polishing wheels wear down over time, meaning that the diameter of the wheel is reduced. In one embodiment pressure sensors are used to determine how to best apply the force between the polishing wheels and the edges of the electronic device. This will allow the system to determine the correct amount of force to be applied no matter the diameter of the wheel used. In another embodiment a sensor is used to determine the diameter of the polishing wheel. A specific diameter is set within the system such that when the electronic device passes this diameter the system will no longer be able to apply the desired force to polish the device. In this embodiment the polishing process will stop and notify a user that the polishing wheel needs changed before polishing can continue.

After the electric device has been polished the system must replace the electronic device in the proper bracket 605. The system then enters a safe mode 606. The safe mode will ensure that the user does not become injured. Lastly, the electronic device is removed from the system 607. In one embodiment, this step only includes physically removing the electronic device from the bracket and the system. In another embodiment, the removal process includes removing the electronic device from the computer system. This removal process could involve updating the electronic device's status to polished.

It is therefore submitted that the methods, systems, and devices have been shown and described in what is considered the most practical and preferred embodiments along with specific examples. It is recognized, however, that departures may be made within the scope, and these present examples are not intended to be limiting. One of ordinary skill the art will be able to discern that obvious modifications can be made without departing from the scope or spirit.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Similarly, it is to be realized that it is not intended for any method set forth herein to be construed as requiring that its steps be performed in a specific order, unless otherwise set forth in the claims.

Therefore, the foregoing is considered as illustrative only of the principles of the disclosure. Further, since numerous modifications and changes will readily occur to those skilled in the art, it is not desired to limit the invention to the exact construction and operation shown and described, and accordingly, all suitable modifications and equivalents may be resorted to, are deemed to fall within.

What is claimed:

1. A system for polishing the edges of an electronic device, the system comprising:

a chamber comprised of a frame having a plurality of sidewalls secured thereto;

a robot arm configured to secure to and move an electronic device;

a polishing machine secured to the frame within range of the robot arm;

a polishing compound plate secured to a pneumatic actuator which is configured to raise and lower the polishing compound plate;

at least one polishing compound located on the polishing compound plate, wherein, polishing compound is applied to the machine by extension of the pneumatic actuator.

2. The system of claim 1 further comprising at least one electronic device slot secured to the frame within the chamber.

3. The system of claim 1 further comprising at least one door configured to allow access to the interior of the chamber.

4. The system of claim 1 further comprising a computer operably coupled to a robot controller.

5. The system of claim 1 further comprising at least one human machine interface (HMI) operably coupled to the system.

6. The system of claim 5, wherein the HMI is configured to display system information.

7. The system of claim 1 wherein the robot arm has an electronic gripper secured to the end which is configured to secure to an electronic device.

8. The system of claim 7 further comprising a stabilizer secured to the gripper, wherein the stabilizer is configured to rest against at least one side of the electronic device;

the stabilizer is secured to the electronic gripper perpendicular to the electronic gripper, wherein the stabilizer includes at least one portion on either side of the electronic gripper.

9. The system of claim 1, wherein, polishing compound is applied to the machine by extension of the pneumatic actuator.

* * * * *